US007090153B2

(12) United States Patent
King et al.

(10) Patent No.: US 7,090,153 B2
(45) Date of Patent: Aug. 15, 2006

(54) FLOW CONDITIONING SYSTEM AND METHOD FOR FLUID JETTING TOOLS

(75) Inventors: Dwain King, Duncan, OK (US); Jim B. Surjaatmadja, Duncan, OK (US); Billy W. McDaniel, Duncan, OK (US); Mark Farabee, Houston, TX (US); David Adams, Katy, TX (US); Loyd East, Frisco, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/901,758

(22) Filed: Jul. 29, 2004

(65) Prior Publication Data

US 2006/0022073 A1 Feb. 2, 2006

(51) Int. Cl.
*B05B 1/14* (2006.01)
*E21B 28/00* (2006.01)
*E21C 45/00* (2006.01)

(52) U.S. Cl. ..... 239/553; 239/556; 239/558; 239/214.21; 166/177.5; 166/222; 166/305.1; 166/308.1; 175/67; 175/424; 299/17

(58) Field of Classification Search ..... 239/553, 239/548, 556, 558, 214.21; 166/177.5, 222, 166/305.1, 308.1; 175/67, 424; 299/17
See application file for complete search history.

(56) References Cited

U.S. PATENT DOCUMENTS 477,824 A * 6/1892 Robinson ..... 239/525
2,315,496 A * 4/1943 Boynton ..... 175/67
2,408,588 A * 10/1946 Watts ..... 239/461
2,660,250 A * 11/1953 Gage et al. ..... 166/99
3,083,765 A * 4/1963 Kammerer ..... 166/290
3,286,771 A * 11/1966 Sisson ..... 166/62
3,486,700 A * 12/1969 Bristow ..... 239/590.5
3,814,330 A * 6/1974 Masters ..... 239/558
3,850,241 A * 11/1974 Hutchinson ..... 166/222
3,905,553 A * 9/1975 Bradley et al. ..... 239/124
3,958,641 A 5/1976 Dill et al.
4,346,761 A 8/1982 Skinner et al.
RE31,495 E * 1/1984 Zublin ..... 166/312
4,518,041 A * 5/1985 Zublin ..... 166/312
4,688,637 A * 8/1987 Theis ..... 166/245
4,899,937 A * 2/1990 Haruch ..... 239/289
5,029,644 A 7/1991 Szarka et al.
5,125,582 A 6/1992 Surjaatmadja et al.
5,361,856 A 11/1994 Surjaatmadja et al.
5,484,016 A 1/1996 Surjaatmadja et al.
5,494,103 A 2/1996 Surjaatmadja et al.
5,518,222 A * 5/1996 Buxton et al. ..... 266/114
5,533,571 A 7/1996 Surjaatmadja et al.
5,587,076 A * 12/1996 Herzog ..... 210/461
5,765,642 A 6/1998 Surjaatmadja
5,779,099 A * 7/1998 D'Andrade ..... 222/79
5,911,285 A * 6/1999 Stewart et al. ..... 175/317

(Continued)

*Primary Examiner*—David A. Scherbel
*Assistant Examiner*—Seth Barney
(74) *Attorney, Agent, or Firm*—John W. Wustenberg; Baker Botts, L.L.P.

(57) ABSTRACT

According to one embodiment of the invention, a flow conditioning system for fluid jetting tools includes a housing having a plurality of jet nozzle openings and a fluid straightener disposed within the housing. The fluid straightener is defined by one or more vanes, and the vanes form a plurality of flow channels within the housing. Each flow channel is associated with at least one jet nozzle opening.

28 Claims, 2 Drawing Sheets

U.S. PATENT DOCUMENTS 6,173,905 B1 * 1/2001 Schultes ..... 239/194
6,325,305 B1 * 12/2001 Kuhlman et al. ..... 239/548
6,607,607 B1 8/2003 Walker et al.
6,951,331 B1 * 10/2005 Haughom et al. ..... 251/180

* cited by examiner

FLOW CONDITIONING SYSTEM AND METHOD FOR FLUID JETTING TOOLS

BACKGROUND

The present invention relates generally to fluid jetting tools and, more particularly, to a flow conditioning system and method.

Various procedures have been developed and utilized to increase the flow of hydrocarbons from hydrocarbon-containing subterranean formations penetrated by wellbores. For example, a commonly used production stimulation technique involves creating and extending fractures in the subterranean formation to provide flow channels therein through which hydrocarbons flow from the formation to the wellbore. The fractures are created by introducing a fracturing fluid into the formation at a flow rate which exerts a sufficient pressure on the formation to create and extend fractures therein. Solid fracture proppant materials, such as sand, are commonly suspended in the fracturing fluid so that upon introducing the fracturing fluid into the formation and creating and extending fractures therein, the proppant material is carried into the fractures and deposited therein, whereby the fractures are prevented from closing due to subterranean forces when the introduction of the fracturing fluid has ceased.

In such formation fracturing procedures, hydraulic fracturing tools use high-pressure fluid directed through relatively small diameter nozzles to obtain the desired result. This high pressure fluid, when turning the corner, may create a large coriolis spin or turbulence before entering the jet nozzle.

SUMMARY

According to one embodiment of the invention, a flow conditioning system for fluid jetting tools includes a housing having a plurality of jet nozzle openings and a fluid straightener disposed within the housing. The fluid straightener is defined by one or more vanes, and the vanes form a plurality of flow channels within the housing. In one embodiment, each flow channel is associated with at least one jet nozzle opening.

Some embodiments of the invention provide numerous technical advantages. Some embodiments may benefit from some, none, or all of these advantages. For example, according to certain embodiments, a fluid straightener reduces the coriolis effect found near the entry of the jet nozzle openings in hydraulic fracturing operations, which reduces the wear inside the jet nozzle openings. Reducing the coriolis effect may also increase the efficiency of the jetting action because there is more fluid energy available for the jetting action. In one embodiment, the flow straightener includes a configuration that may prevent or substantially reduce a channel blockage from preventing or substantially reducing flow through the jet nozzles. Many configurations are available for the fluid straightener.

Other technical advantages are readily apparent to one skilled in the art.

DETAILED DESCRIPTION

Figure 1A:
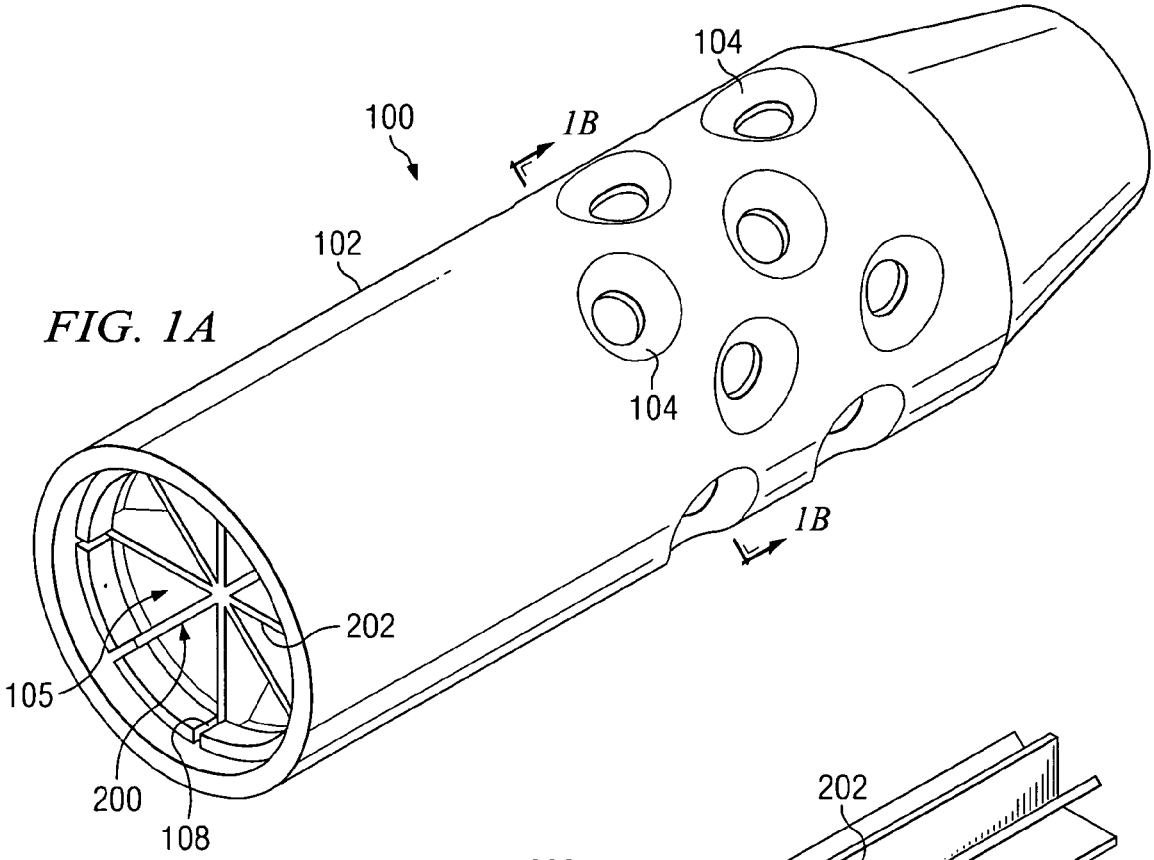
FIG. 1A is a perspective view.
Figure 1B:
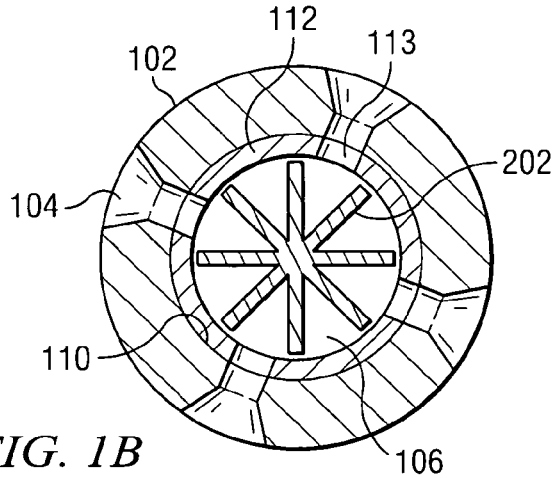
FIG. 1B is a cross-section, of a fluid straightener disposed within a jetting tool in accordance with one embodiment of the present invention.

FIG. 1A is a perspective view, and FIG. 1B is a cross-section, of a jetting tool 100 in accordance with one embodiment of the present invention. In the illustrated embodiment, jetting tool 100 is a hydraulic fracturing tool for use in hydraulic fracturing operations within a wellbore, such as Halliburton's SURGIFRAC fracturing service. However, jetting tool 100 may be any suitable downhole tool that includes jet nozzle openings. In the embodiment illustrated in FIGS. 1A and 1B, jetting tool 100 includes a housing 102 having a fluid straightener 200 disposed therein and a plurality of jet nozzle openings 104.

Housing 102 is any suitably shaped housing having any suitable length and formed from any suitable material. In one embodiment, housing 102 is a cylindrically shaped housing having a diameter suitable for attaching to portions of tubing at both of its ends so that a suitable fluid may flow therethrough. Any suitable number of jet nozzle openings 104 may be utilized and they may be located in any suitable location and arranged in any suitable arrangement in housing 102. For example, jet nozzle openings 104 may be in-line or offset from one another. Each jet nozzle opening 104 may have any suitable configuration and may be oriented within the wall of housing 102 in any suitable orientation. In a particular embodiment, jet nozzle openings 104 are formed directly in the wall of housing 102 and are no more than approximately one-half inch in throat diameter. However, jet nozzle openings 104 may be formed in any suitable manner, such as from jet nozzles screwed into the wall of housing 102.

During fracturing operations, a fracturing fluid or other suitable fluid flows through a bore 105 of housing 102 and is directed out jet nozzle openings 104 in order to create fractures within a formation adjacent to the wellbore (not illustrated). The fluid may flow at high-velocity and/or high-pressure. Fluid straightener 200 may be utilized within housing 102 to limit, reduce, or otherwise control the flow of the fluid through bore 105 of housing 102.

Figure 2:
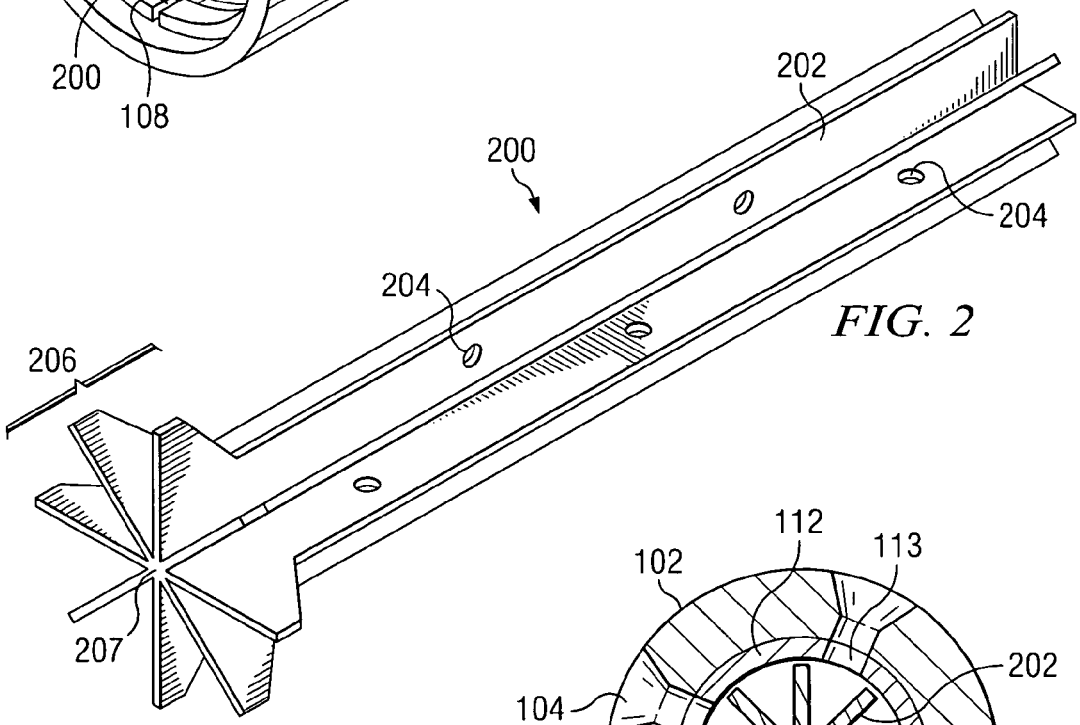
FIG. 2 is a perspective view of the fluid straightener of FIGS. 1A and 1B in accordance with one embodiment of the present invention.

Fluid straightener 200, which is described in greater detail below in conjunction with FIG. 2, is defined by one or more vanes 202 that form a plurality of flow channels 106 (FIG. 1B) within bore 105 of jetting tool 100. Each flow channel 106 may be associated with at least one of the jet nozzle openings 104, which means that each flow channel 106 delivers or directs fluid to at least one jet nozzle opening 104. In one embodiment, flow channels 106 may function to reduce the turbulence of the fluid flowing through bore 105 in order to reduce any coriolis effect at the entry of jet nozzle openings 104. The number and configuration of flow channels 106 is dependent upon the number and configuration of vanes 202 of fluid straightener 200. In the embodiment illustrated in FIGS. 1A and 1B, eight vanes 202 are illustrated, thereby forming eight flow channels 106.

Although fluid straightener 200 may be disposed within bore 105 of jetting tool 100 in any suitable manner, in the illustrated embodiment, an upper portion 206 of vanes 202 engage respective grooves 108 formed in an inside wall 110 of housing 102. Grooves 108 may prevent rotation of fluid straightener 200 within bore 105 and may facilitate the correct positioning of fluid straightener 200 therein. Other suitable coupling methods may also be utilized to secure fluid straightener 200 within bore 105, such as a press fit. As illustrated in FIG. 1B, a gap may exist between the ends of each vane 202 and inside wall 110 of housing 102 to allow fluid to flow from one channel 106 to another. In other embodiments, the ends of vanes 202 may contact or engage inside wall 110.

Referring to FIG. 2, fluid straightener 200 according to one embodiment of the invention is illustrated in perspective view. Fluid straightener 200 is any suitable structure that functions to control the flow of fluid through bore 105. Although eight vanes 202 are shown in FIG. 2, any suitable number of vanes or other suitable structures may be utilized to define fluid straightener 200. For example, a single plate may be utilized that would form two vanes 202 to create two separate flow channels 106 within bore 105, four vanes 202 may be utilized to create four separate flow channels 106, or more than four vanes 202 may be utilized to create any suitable number of flow channels 106. Vanes 202 may couple to one another at any suitable location. In one embodiment, vanes 202 couple at a common center 207 that corresponds to an axis of bore 105. A cross-section of fluid straightener 200 as defined by vanes 202 may take any suitable form. For example, fluid straightener 200 may have a cross-section that divides bore 105 into two approximately equal halves, three approximately equal thirds, four approximately equal fourths, or other suitable apportionment.

Also illustrated in FIG. 2 are a plurality of apertures 204 formed in each vane 202. Apertures 204, if utilized, may have any suitable size and shape and may be located on each vane 202 in any suitable manner. For example, apertures 204 may be arranged in rows or may be randomly formed in vanes 202. In addition, any suitable number of apertures 204, including none, may be formed in each vane 202. Apertures 204 function to allow some fluid communication between flow channels 106 when fluid straightener 200 is disposed within bore 105 of housing 102. This may prevent any blockage of a flow channel 106 from preventing flow through the jet nozzle openings 104 associated with that particular flow channel 106.

Referring back to FIG. 1B, in order to help reduce the wear at the entry of jet nozzle openings 104, a removable insert 112 may be utilized within bore 105 of housing 102. Removable insert 112 may have any suitable size and shape; however, removable insert 112 generally conforms to the contour of inside wall 110 of housing 102. Removable insert 112 includes a plurality of openings 113 that correspond to respective ones of jet nozzle openings 104. Openings 113 may have any suitable diameter; however, openings 113 generally have a slightly greater diameter than the throat of jet nozzle openings 104. Removable insert 112, in one embodiment, is selectively removable from bore 105 so that it may be replaceable when desired.

Figure 3:
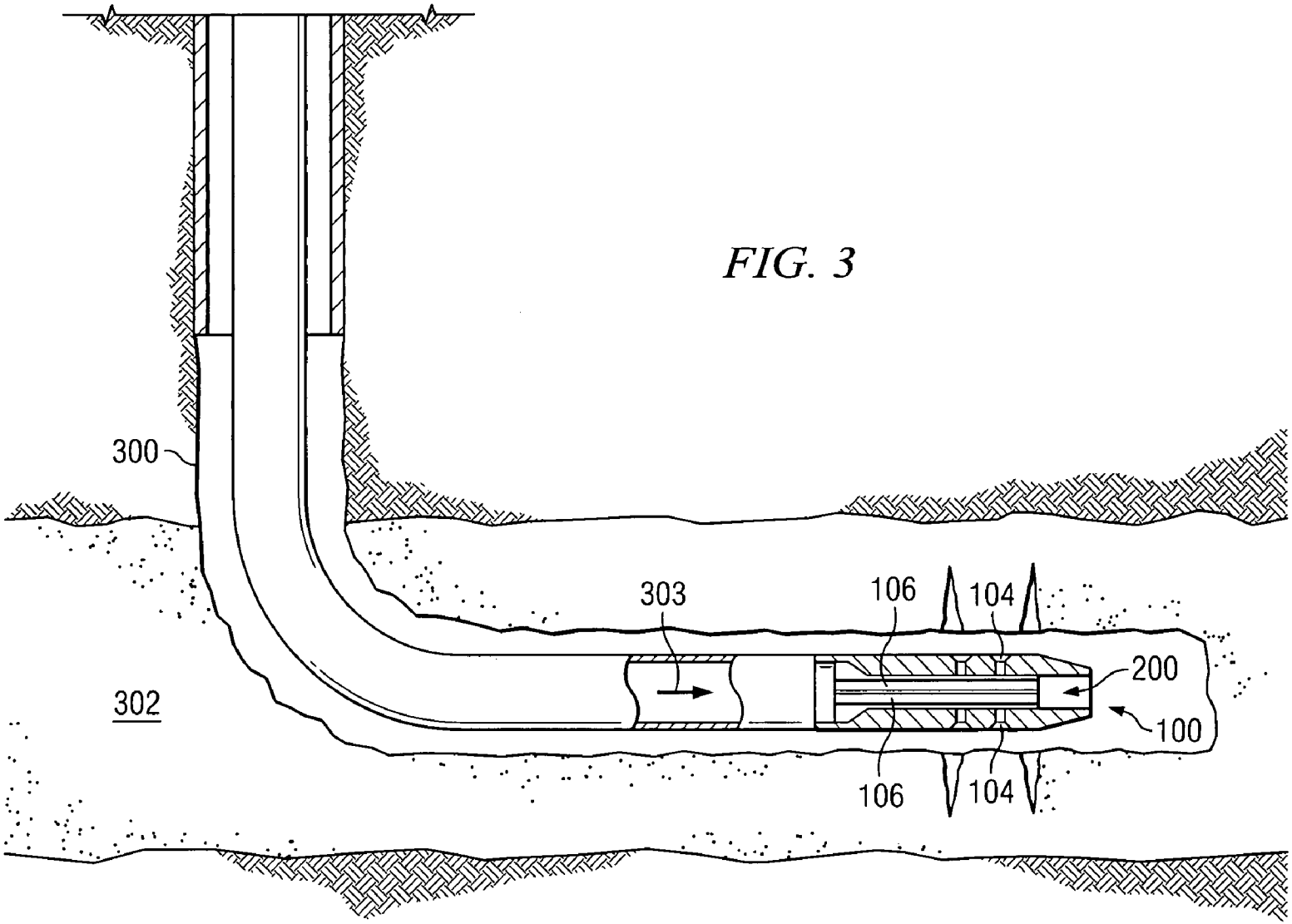
FIG. 3 is an elevation view of a well showing a jetting tool disposed therein according to one embodiment of the invention.

Referring now to FIG. 3, in operation of one embodiment of the invention, fluid straightener 200 is disposed within bore 105 of jetting tool 100 by engaging upper portion 206 of vanes 202 with grooves 108. Jetting tool 100 is then disposed within a wellbore 300. As described above, the vanes 202 of flow straightener 200 form flow channels 106, wherein each flow channel 106 is associated with at least one jet nozzle opening 104. Any particular jet nozzle opening 104 may be plugged purposely for flow rate modification, in which case there may not be any jet nozzle opening 104 exposed to one or more flow channels 106.

A fracturing (frac) fluid or other suitable fluid is then circulated down through wellbore 300, as indicated by arrow 303, and through bore 105 and is separated into separate flow paths corresponding to the separate flow channels 106. The frac fluid then flows through jet nozzle openings 104 under high velocity and/or high pressure to subsequently fracture a formation 302 adjacent wellbore 300. Because flow channels 106, in the illustrated embodiment, function to reduce turbulence within bore 105, the coriolis effect at the entry of jet nozzle openings 104 is reduced, thereby extending the life of jet nozzle openings 104 and maintaining the efficiency of the hydraulic fracturing operation.

Although some embodiments of the present invention are described in detail, various changes and modifications may be suggested to one skilled in the art. The present invention intends to encompass such changes and modifications as falling within the scope of the appended claims.

What is claimed is:

1. A flow conditioning system for fluid jetting tools, comprising:

a housing having a plurality of jet nozzle openings formed in a side wall of the housing; and a fluid straightener disposed within the housing;

wherein:

the fluid straightener comprises one or more vanes;

the one or more vanes form a plurality of flow channels within the housing;

each flow channel is in fluid communication with at least one jet nozzle opening; and each jet nozzle opening is in fluid communication with only one flow channel.

2. The flow conditioning system of claim 1 wherein at least one of the one or more vanes has one or more apertures formed therein.

3. The flow conditioning system of claim 2 wherein the one or more apertures is a plurality of apertures formed in each of the one or more vanes.

4. The flow conditioning system of claim 1 wherein a portion of the one or more vanes engage respective grooves formed in an inside wall of the housing.

5. The flow conditioning system of claim 1 wherein the one or more vanes engage an inside wall of the housing.

6. The flow conditioning system of claim 1 wherein the one or more vanes comprises a plurality of vanes that couple at a common center that corresponds to a center of the housing.

7. The flow conditioning system of claim 6 wherein the one or more vanes divide a bore of the housing into one of two approximately equal halves, three approximately equal thirds, and four approximately equal fourths.

8. The flow conditioning system of claim 1 further comprising a removable insert disposed within the housing, wherein the insert has a plurality of openings corresponding to respective ones of the jet nozzle openings.

9. The flow conditioning system of claim 1 wherein the housing is a hydraulic fracturing sub.

10. A method of conditioning fluid flow through a jetting tool, comprising the steps of:

positioning a jetting tool within a well, wherein the jetting tool comprises a housing having a plurality ofjet nozzle openings formed in a side wall of the housing;

forming a plurality of flow channels within the housing, wherein each flow channel is in fluid communication with at least one jet nozzle opening and each jet nozzle opening is in fluid communication with only one flow channel; and flowing a fluid through the flow channels and out at least one of the jet nozzle openings.

11. The method of claim 10 further comprising the step of providing fluid communication between flow channels.

12. The method of claim 10 wherein the step of forming a plurality of flow channels within the housing further comprises the step of disposing a removable insert within the housing, wherein the insert has a plurality of openings corresponding to respective ones of the jet nozzle openings.

13. The method of claim 10 wherein the step of forming a plurality of flow channels within the housing further comprises the step of disposing a fluid straightener within the housing, wherein the fluid straightener comprises one or more vanes.

14. The method of claim 13 further comprising the step of providing at least one aperture in each of the one or more vanes.

15. The method of claim 13 further comprising the step of engaging a portion of each of the one or more vanes with respective grooves formed in an inside wall of the housing.

16. The method of claim 13 further comprising the step of engaging the one or more vanes with an inside wall of the housing.

17. The method of claim 10 wherein the jetting tool is a hydraulic fracturing sub.

18. A flow conditioning system for fluid jetting tools, comprising:

a hydraulic fracturing sub having a plurality of jet nozzle openings formed in a side wall of the hydraulic fracturing sub;

a fluid straightener disposed within the hydraulic fracturing sub, wherein:

the fluid straightener comprises one or more vanes;

the one or more vanes form a plurality of flow channels within the hydraulic fracturing sub;

each flow channel is in fluid communication with at least one jet nozzle opening;

each jet nozzle opening is in fluid communication with only one flow channel;

one or more apertures formed in each of the one or more vanes allow fluid communication between the flow channels; and a portion of each of the one or more vanes engages respective ones of a plurality of grooves formed in an inside wall of the hydraulic fracturing sub; and a removable insert disposed within the hydraulic fracturing sub, wherein the insert has a plurality of openings corresponding to respective ones of the jet nozzle openings.

19. The flow conditioning system of claim 18 wherein a portion of each of the one or more vanes is tapered.

20. The flow conditioning system of claim 18 wherein the one or more vanes engage an inside wall of the hydraulic fracturing sub.

21. The flow conditioning system of claim 18 wherein the one or more vanes comprises a plurality of vanes that couple at a common center that corresponds to a center of the hydraulic fracturing sub.

22. The flow conditioning system of claim 21 wherein the one or more vanes divide a bore of the hydraulic fracturing sub into one of two approximately equal halves, three approximately equal thirds, and four approximately equal fourths.

23. The flow conditioning system of claim 1, wherein the fluid straightener is positioned angularly to the plurality ofjet nozzle openings.

24. The flow conditioning system of claim 1, wherein the fluid straightener is positioned perpendicularly to the plurality ofjet nozzle openings.

25. The method of claim 10, wherein each of the plurality of flow channels is disposed angularly to the at least one jet nozzle opening with which the flow channel is associated.

26. The method of claim 10, wherein each of the plurality of flow channels is disposed perpendicularly to the at least one jet nozzle opening with which the flow channel is associated.

27. The flow conditioning system of claim 18, wherein the fluid straightener is positioned angularly to the plurality ofjet nozzle openings.

28. The flow conditioning system of claim 18, wherein the fluid straightener is positioned perpendicularly to the plurality ofjet nozzle openings.

* * * * *